US005380151A

United States Patent [19]

Kostka et al.

[11] Patent Number: 5,380,151

[45] Date of Patent: Jan. 10, 1995

[54] AXIALLY OPENING CYLINDRICAL BLEED VALVE

[75] Inventors: Richard A. Kostka, Thornhill; Vittorio Bruno, Mississauga, both of Canada

[73] Assignee: Pratt & Whitney Canada, Inc., Longueuil, Canada

[21] Appl. No.: 135,710

[22] Filed: Oct. 13, 1993

[51] Int. Cl.[6] ..... F01D 17/00

[52] U.S. Cl. ..... 415/145; 415/150; 415/157; 60/39.23; 60/39.29

[58] Field of Search ..... 415/126, 144, 145, 150, 415/157, 158, 166, 28; 60/39.23, 39.07, 39.29

[56] References Cited

U.S. PATENT DOCUMENTS 1,862,289 6/1932 Anderson .
2,092,961 9/1937 Eickstaedt .
2,473,620 6/1949 Teague, Jr. .
2,645,244 7/1953 Klickman .
2,693,904 11/1954 Boyd .
2,702,665 2/1955 Ledwith .
2,850,227 9/1958 Wheatley .
3,360,189 12/1967 Cook .
3,398,928 8/1968 Fredd .
3,638,428 2/1972 Shipley et al. .
3,747,341 7/1973 Davis ..... 415/145
3,898,799 8/1975 Pollert et al. .
3,941,498 3/1976 Duckworth et al. ..... 415/150
4,050,240 9/1977 Vaught ..... 60/39.23
4,120,156 10/1978 McInerney .
4,522,592 6/1985 Johnson .
4,715,779 12/1987 Suciu .
4,827,713 5/1989 Peterson et al. .
4,886,416 12/1989 Wunderlich ..... 415/158
4,998,562 3/1991 Foltz .

*Primary Examiner*—Edward K. Look
*Assistant Examiner*—Christopher Verdier
*Attorney, Agent, or Firm*—Alan C. Cohen

[57] ABSTRACT

A bleed valve for a gas turbine engine having a housing of two segments and which form a gas flow path through the compressor, in which a first segment is movable from the second segment thereby creating an opening between the two segments. The moveable segment having one or more arms with rollers attached thereto where the stationary segment has paths on which the rollers travel, as the moveable segment is caused to move away from the stationary segment thereby opening the valve.

3 Claims, 5 Drawing Sheets fig.2
prior art
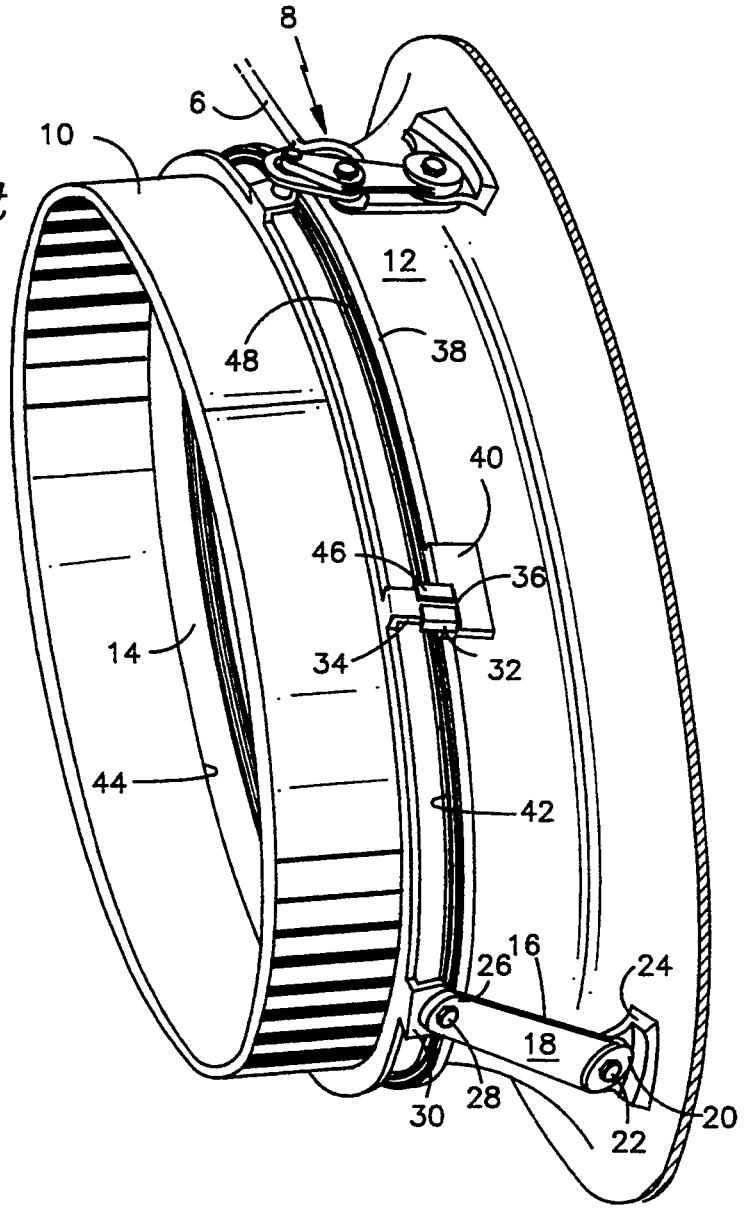
fig.3
prior art
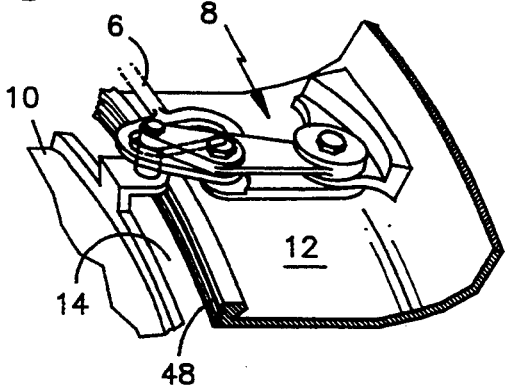
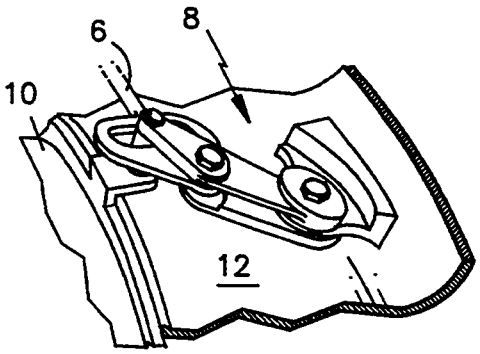
fig.4
prior art

AXIALLY OPENING CYLINDRICAL BLEED VALVE

TECHNICAL FIELD

The technical field to which this invention pertains is gas turbine engines, particularly bleed valves for gas turbine engines.

BACKGROUND OF THE INVENTION

In gas turbine engines (see FIG. 1) for use in powering aircraft, air is directed through multiple stage compressors as it flows axially or axially and radially through the engine to a burner. As the air passes through each successive compressor stage, the pressure of the air is increased. Under certain conditions, such as when the engine is throttled back or during start up, the amount of air required in the burner is less than that flowing through the compressor. In this condition an engine surge or blow-out may occur, endangering the operation of the engine and the associated aircraft.

To mitigate against these conditions, such gas turbine engines have incorporated bleed valves in the engine casing forward of the burner which, when an engine surge is imminent, open to reduce airflow to the burner. These bleed valves have taken many forms from simple ports in the compressor casing which open via a movable valve clement to devices which separate adjacent segments of the engine casing thereby creating an opening. there between One prior art bleed valve employing a moveable segment is depicted in FIGS. 2, 3 and 4. This bleed valve is operated by applying a tangential force derived from pressurized engine fuel, via a rod 6, to a linkage 8 connected to a movable segment 10 of the engine casing 11. The force moves the movable segment 10 in a helical direction such that the movable segment rotates tangentially about the air flow as well as moving the segment 10 forward toward the engine inlet 13. As the moveable segment 10 moves away from the stationary segment 12, an opening 14 is created between the moveable segment 10 and the stationary segment 12, permitting the pressurized air to escape, thereby lowering the air pressure in that portion of the compressor stage and consequently the pressure in the air reaching the burner. The relative position of the two segments along the axis is maintained by the linkage 8 as well as two other linkages 16 spaced about the outside of the stationary segment 12. These linkages comprise a flat metal connector 18 having two ends, a first end 20 being affixed to the outside surface of the stationary segment 12 via a pin 22 and mount 24 while the second end 26 is connected to the outside surface of the moveable segment 10 via a second pin 28 attached to a second mount 30 on the outer surface of the moveable segment 10. The linkages 16 connecting the stationary segment 12 with the movable segment 10 maintain the relative position of the two segments along the axis during operation of the bleed valve. This is important as the clearances inside the engine are limited and damage could occur if the segments were permitted to move outside their relative positions. To further assist in maintaining the position of the two segments during operation maintenance pads 32 are used. These comprise an L-shaped overhang or arm 34 affixed to the moveable segment 10 such that the distal end 36 of the overhang lies below the lip 38 of the stationary segment 12 and is in contact with a tab 40 positioned on the outside surface of the stationary segment 12 just below the lip 38 of the stationary segment. The end of the over hang 36 has a covering 46 of a friction reducing material to reduce the friction between the tab and the over hang as the moveable segment rotates during opening and closing. To insure that the seal is indeed sealed, coaxial mating lands and grooves 48 are formed in both the mating surfaces 42 and 44 which, when the valve is closed, improve the seal between the two surfaces.

During a potential surge condition or other condition, when the bleed valve must be open, the valve must respond quickly and without hesitation. Although the prior art design is adequate, with the limited force available from the fuel pressure to actuate the valve and the hot, dirty environment in which these valves operate, improvements are constantly being sought to lower the three required to operate the valves and to prevent fouling due to contamination which may slow the response of the valves. In addition, the mechanical linkages used to control the motion of the moveable segment permit more than the optimum amount of lateral motion desired. Further, the tabs and overhangs fixed to the bleed valve segments add weight and machining operations to the construction of the valve which translates into additional manufacturing costs. Therefore, what is needed in this art is an improved system to open and close the bleed valve of this design which would reduce the force required to open the valve and improve on the relative motion of the moveable segment and be less costly to manufacture.

DESCRIPTION OF THE INVENTION

A feature of the present invention is an improved means for actuating the bleed valve of the prior art type having two segments one moveable and one stationary. The invention permits the valve to open with less force than previously required. This is achieved by applying a force to the movable segment of the valve wherein the force urges the moveable segment to rotate coaxially about the axis of the engine. As the moveable segment starts to rotate, rollers, which are affixed to the moveable segment at a predetermined angle and which ride in angled paths formed in the external surface of the stationary segment, are urged to move along the path thereby imparting an axial motion to the moveable segment. This causes the moveable segment to move in a helical motion away from the stationary segment creating an opening between the stationary segment and the moveable segment through which compressed air can pass.

DESCRIPTION OF THE DRAWINGS

FIG. 2 is a perspective of the prior art air bleed valve.

FIG. 3 is a perspective of the linkage of the prior art bleed valve in the open position.

FIG. 4 is a perspective of the linkage of the prior art bleed valve in the closed position.

BEST MODE FOR CARRYING OUT THE INVENTION

Figure 1:
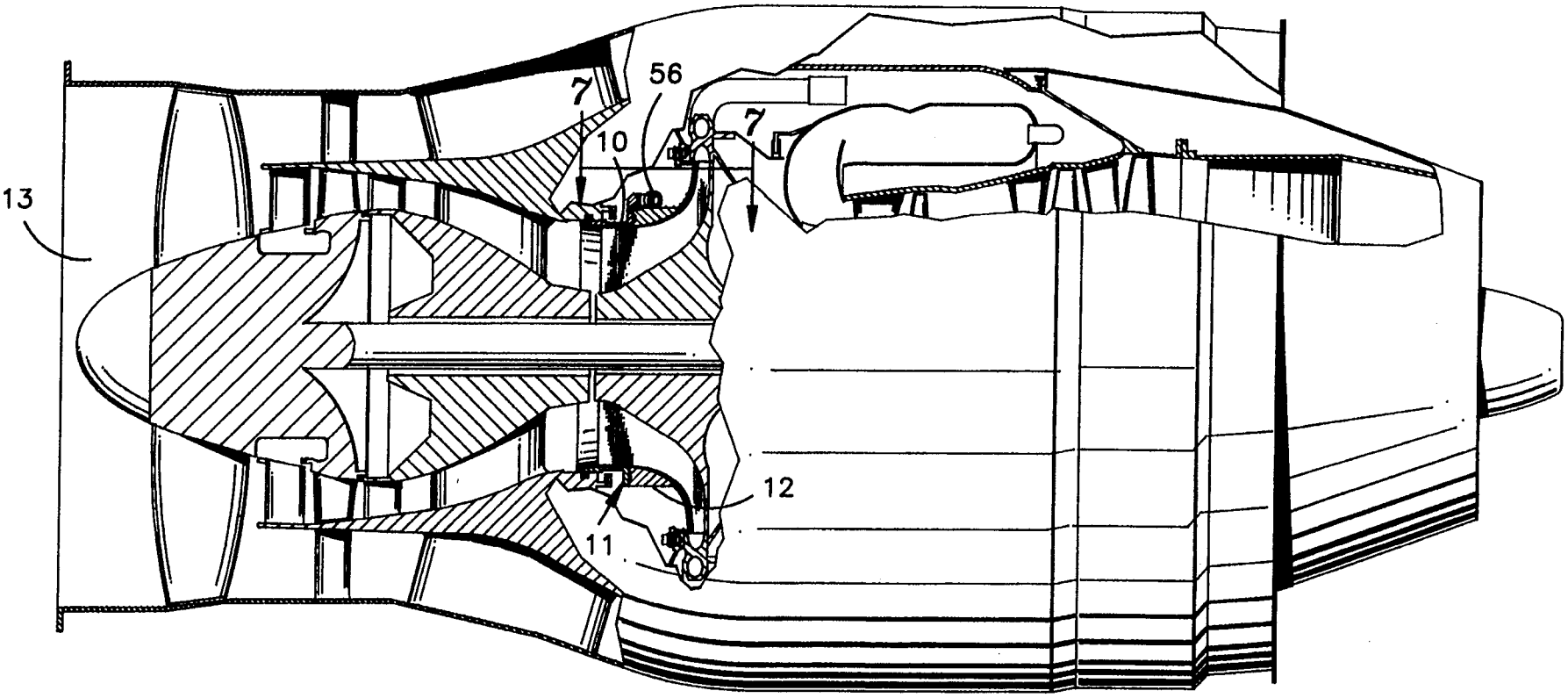
FIG. 1 is a cross section of a gas turbine engine of the type using the present invention.
Figure 6:
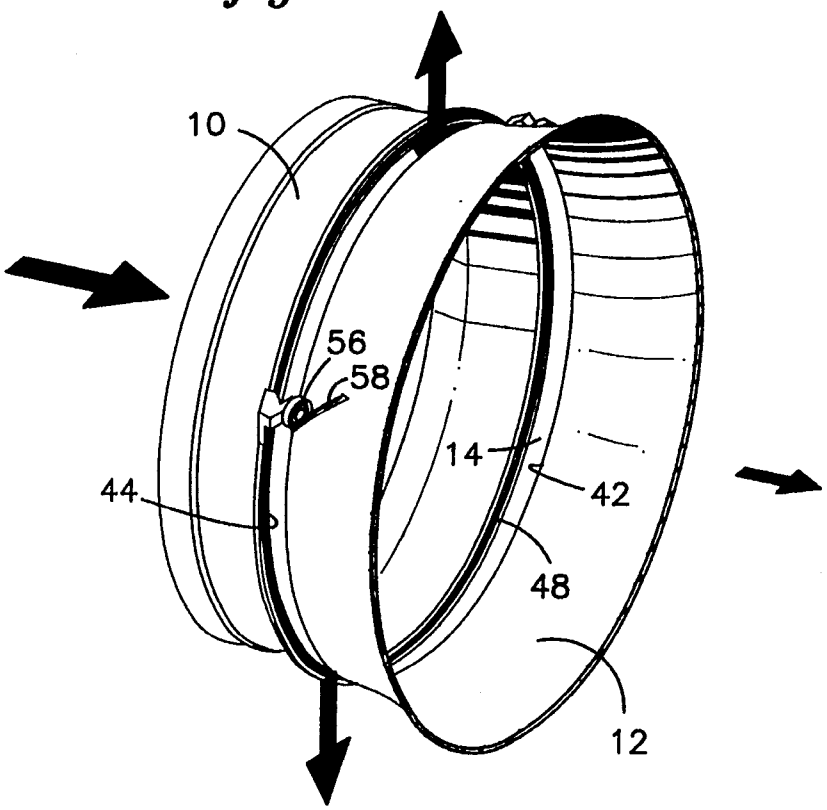
FIG. 6 is a perspective view of the air bleed valve of the present invention in the open position.
Figure 5:
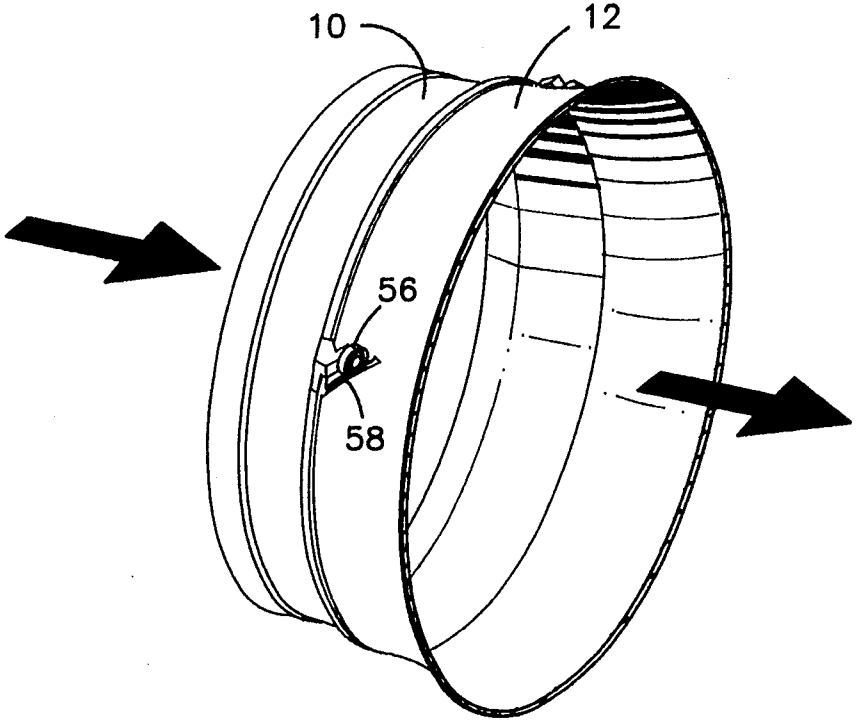
FIG. 5 is a perspective view of the air bleed valve of the present invention in the closed positioned.
Figure 8:
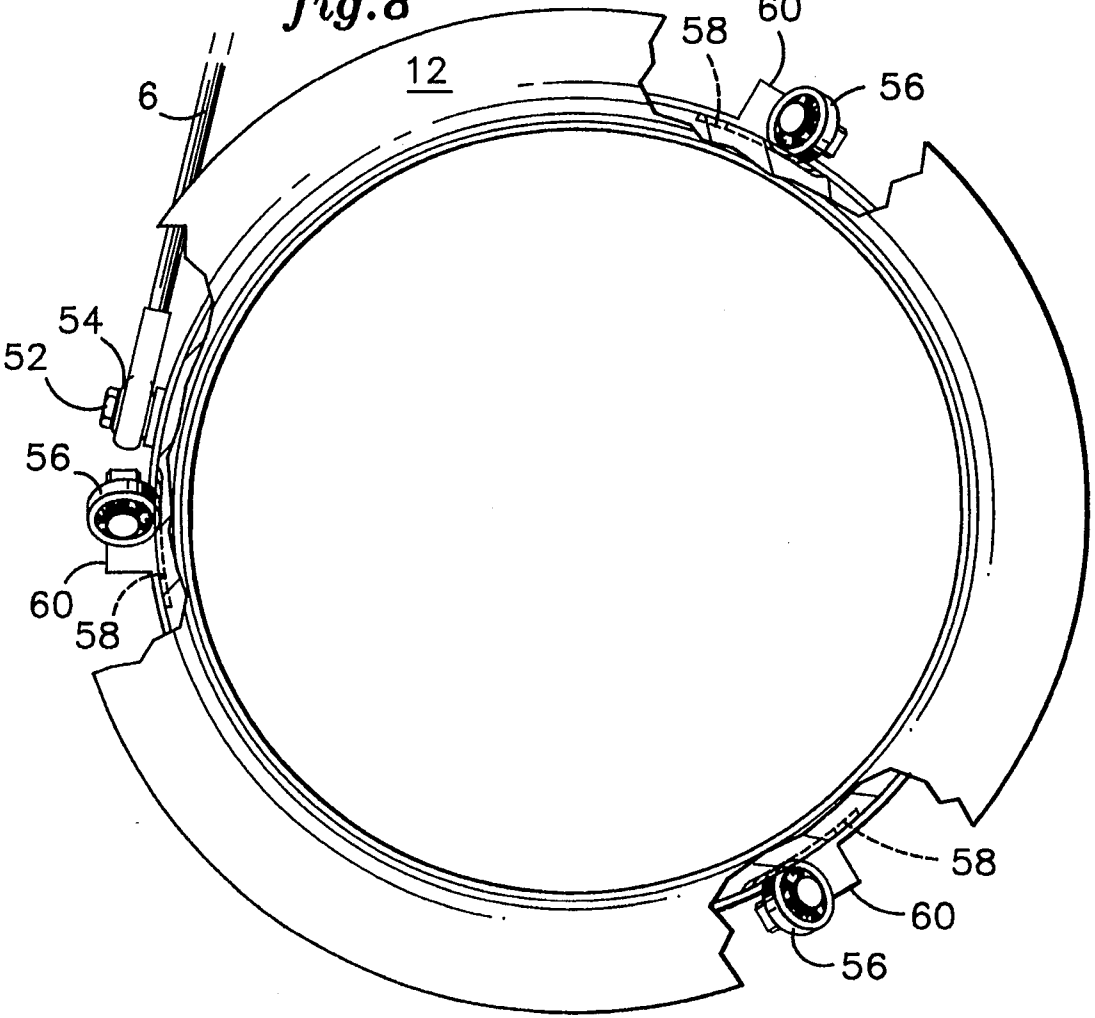
FIG. 8 is a view in the direction of the arrow 8 in FIG. 7.
Figure 7:
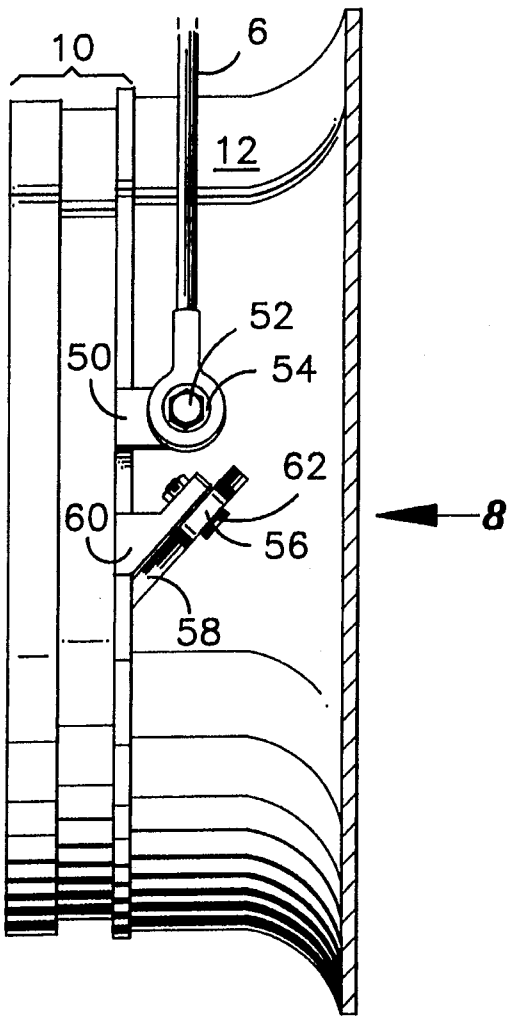
FIG. 7 is a side view of the air bleed valve of the present invention in the closed position.
Figure 10:
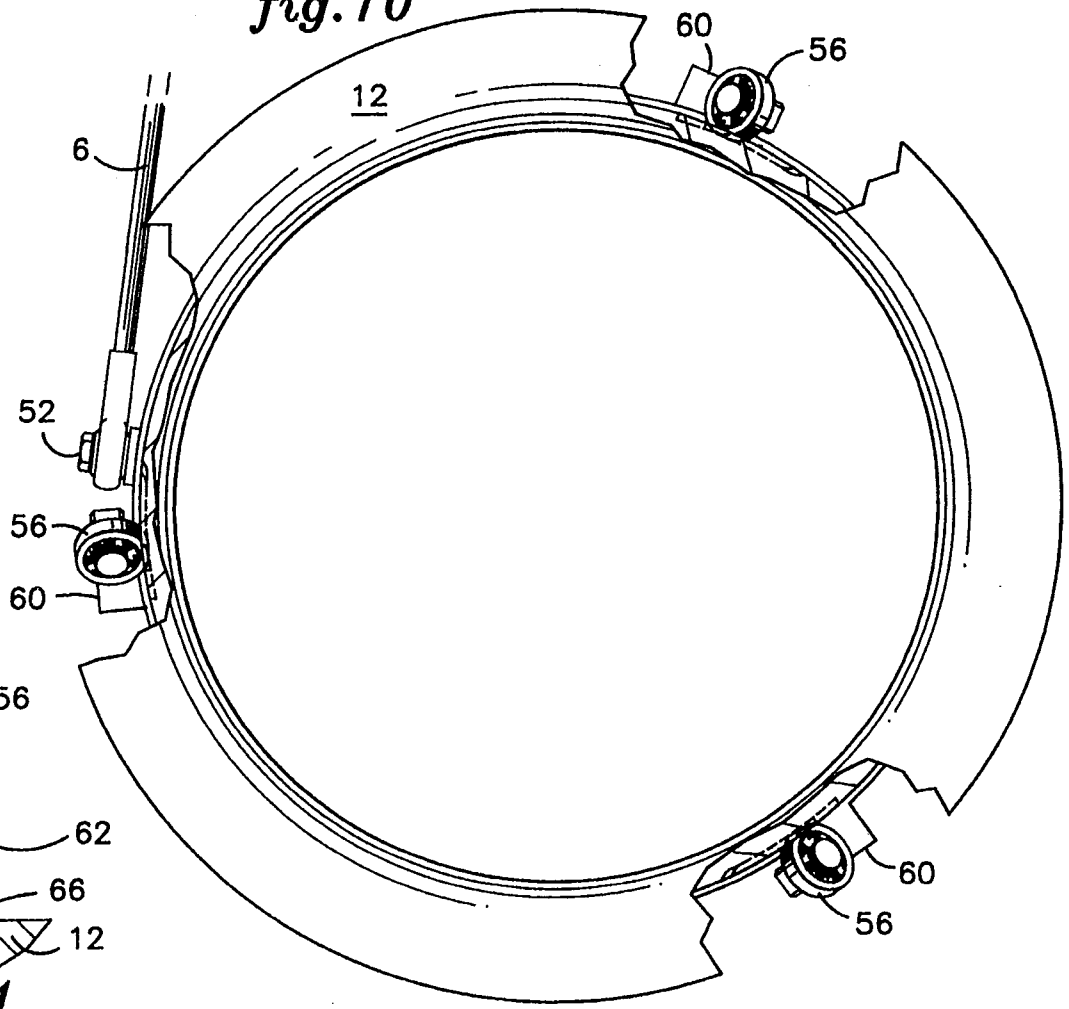
FIG. 10 is a view of in the direction of the arrow 10 in FIG. 9.
Figure 11:
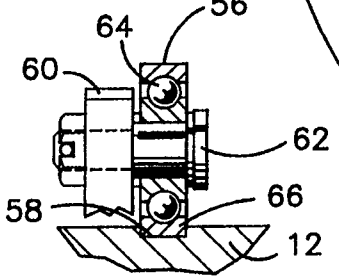
FIG. 11 is a cross section of a roller.

The present invention is best understood by referring to FIGS. 5–11. FIG. 5 and 6 are perspective views of the present invention comprising a moveable segment 10 and a stationary segment 12 each are the same as the prior art with the moveable segment being positioned forward of the stationary segment. As depicted in FIG. 5, when the bleed valve is in the closed position all of the compressed air from the compressors forward of the bleed valve are directed through the bleed valve along the central axis of the engine to the burner section (not shown) aft of the bleed valve. When the bleed valve is opened, as shown in FIG. 6, a portion of the compressed air flowing axially through the engine is diverted through the opening 14 created in the bleed valve.

Figure 9:
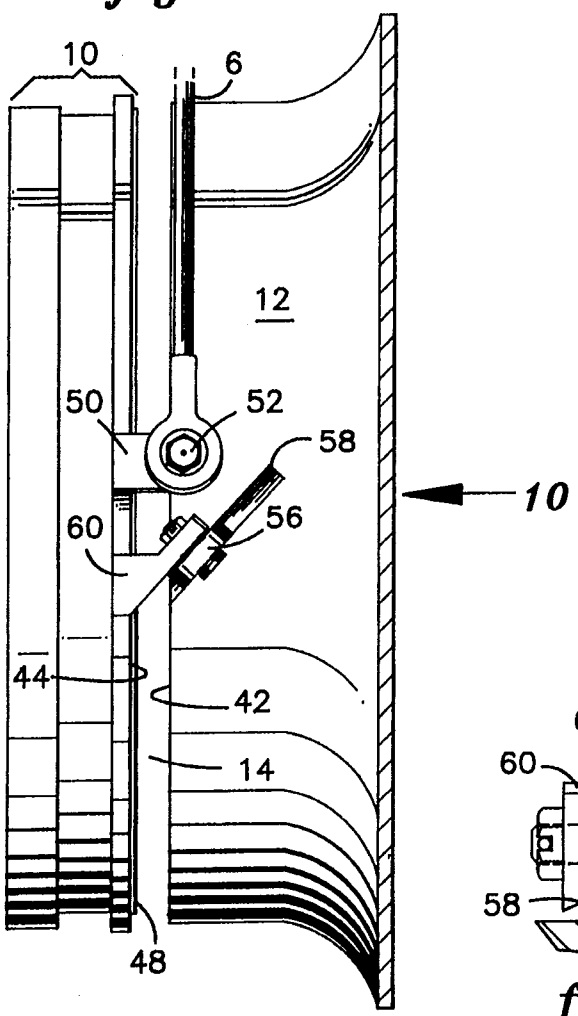
FIG. 9 is a side view of the air bleed valve of the present invention in the open position.

The valve is operated by applying a force, preferably a force tangential to the central axis, to the moveable segment 10 sufficient to urge the moveable segment 10 to rotate about the central axis. In practice the force is preferably generated frown the fuel pressure and applied to the moveable segment through a rod 6 connected to a flange 50 via a pin 52 and roller connection 54 fixed to the moveable segment 10. As the moveable segment 10 begins to rotate, a series of bearings 56 affixed to the movable segment 10 ride in a path 58 along the surface of the stationary segment 12. The path 58 is designed at an angle such that as the rollers 56 ride along the path 58, the moveable segment 10 is caused to move axially as well as tangentially, thereby causing the two segments to part and creating an opening 14 between them as shown in FIG. 9.

As may be seen in FIGS. 7–11, the rollers 56 are attached to arms 60 by means of pins 62. The inner race of the roller 56 is press fitted onto the pin 62 while the outer race 66 of the roller 56 rides in the path 58 and moves over the bearings 64. These paths may take many forms. The one depicted herein is machined into the surface of the casing while others could be formed onto the surface of the casing. The preferred rollers are conventional sealed bearings which would reduce the chance for contamination to penetrate into the roller assembly and create problems.

The valve design depicted herein has three rollers and three paths equally spaced apart. However, depending on the design criteria more such bearings may be used. The bearings not only reduce the force necessary to open the valve over that required in the prior art design but maintain the relative position of the two housing segments so that they remain in axial alignment during opening and closing. The position of the paths and the angle at which they are placed will depend on the distance the valve is to be opened and the length of the stroke necessary to move the bearing along the path. Generally the angle of the path will be between about 25 to about 80 degrees to the central axis of the engine with about 45 degrees being preferred.

A test between the prior art bleed valve and the present invention were prepared to determine the amount of energy necessary to operate each valve. The test comprised placing both the prior an valve and the valve of the present invention on a table with the stationary segment horizontal to the surface of the table. A forty pound weight was placed on the moveable segment 10. The valve was then actuated by applying a force sufficient to open the valve and measuring the amount of force necessary in each case. The results were that the prior art valve required 90 pounds of force to operate while the present invention required only 40 pounds. This is a reduction of greater than 50% of the force necessary to open the valve. This translates into a faster, more responsive valve. In addition with the replacement of the linkages of the prior art with the bearings of the present design there is less likelihood of fouling due to environmental contamination. In addition having the bearings move in the paths maintains the relative positions of the segments so that the pads 32 of the prior art are no longer necessary, thereby reducing the cost of manufacture of the valve.

What is claimed is:

1. A gas turbine engine having one or more compressor stages within a segmented housing, said housing forming an axial gas flow path through the compressor stages, said housing having a bleed valve positioned coaxially about the central axis of the engine and downstream from at least one of said compressor stages, said bleed valve causing at least one segment of the housing to move in an axial direction creating an opening in the periphery of the casing permitting bleed off of pressurized fluid wherein the improvement comprises;

said segmented housing including a first housing segment having at least one arm and one or more rollers attached thereto;

a second housing segment having one or more paths in which the rollers travel;

a mechanical connection for applying a force to the arm thereby causing the rollers to move along the path or said paths resulting in the first housing segment to create said opening to move axially away from the second segment.

2. The bleed valve of claim 1 wherein the path or said paths are formed at between about 25 degrees to about 80 degrees tangent to the axial flow path.

3. A gas turbine engine having one or more axial compressor stages and a centrifugal compressor downstream from the axial compressors, said compressors housed within a segmented housing, said segmented housing having a first housing segment and a second housing segment, forming a gas flow path through the compressor stages, said segmented housing having a bleed valve positioned coaxially about the central axis of the engine and downstream from the axial compressor stages, said bleed valve causing at least one segment of the housing to move in an axial direction creating an opening in the periphery of the housing permitting bleed off of pressurized fluid wherein the improvement comprises;

said segmented housing including a moveable segment having at least one arm and one or more rollers attached thereto;

a stationary segment having one or more paths in which the rollers travel;

a mechanical connection for applying a tangential force to the arm thereby causing the rollers to move along the path or said paths resulting in the first housing segment to move axially away from the second segment creating said opening in the periphery of the casing.

* * * * *